United States Patent [19]

Kuus et al.

[11] 4,305,017

[45] Dec. 8, 1981

[54] HALOGEN INCANDESCENT LAMP

[75] Inventors: Gijsbert Kuus; Adriaan J. De Ridder, both of Eindhoven, Netherlands

[73] Assignee: U.S. Philips Corporation, New York, N.Y.

[21] Appl. No.: 103,671

[22] Filed: Dec. 14, 1979

[51] Int. Cl.[3] ..... H01J 19/68

[52] U.S. Cl. ..... 313/174; 313/178; 313/222

[58] Field of Search ..... 313/174, 176, 178, 179, 313/222

[56] References Cited

U.S. PATENT DOCUMENTS

| | | | |
|---|---|---|---|
| 3,829,731 | 8/1974 | T'Jampens et al. | 313/174 |
| 4,039,879 | 8/1977 | T'Jampens et al. | 313/222 X |
| 4,074,167 | 2/1978 | Broek et al. | 313/222 |

*Primary Examiner*—Stanley T. Krawczewicz
*Attorney, Agent, or Firm*—Robert S. Smith

[57] ABSTRACT

A halogen incandescent lamp having a light-pervious envelope containing a gas filling comprising a rare gas, hydrogen and bromine. The envelope also contains a tungsten filament and an oxygen getter. The oxygen getter consists of an intermetallic compound of at least one first metal from the group consisting of Ta, Ti, Zr, Hf and Nb and at least one second metal from the group consisting of Pd, Pt and Au, but which intermetallic compound is not a tantalum-gold or a niobium-gold compound.

These intermetallic compounds are sufficiently stable that although they react with oxygen, they do not react with hydrogen bromide.

Consequently the presence of such an intermetallic compound in such a halogen incandescent lamp does not interfere with the tungsten-bromine cycle, and thus the maximum quantity of the intermetallic compound which is present in such a lamp is not critical.

3 Claims, 2 Drawing Figures

HALOGEN INCANDESCENT LAMP

Figure 1:
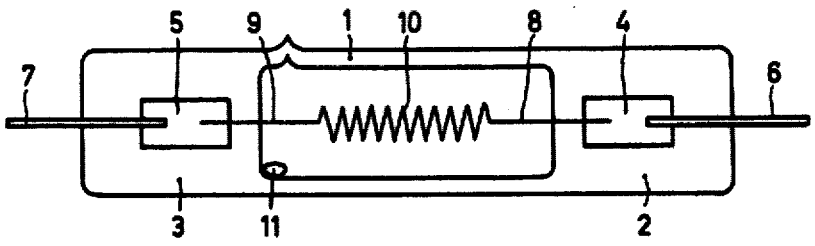

The invention relates to a halogen incandescent lamp having a light-pervious envelope containing a gas filling comprising hydrogen bromide and a rare gas. Disposed in the envelope is tungsten filament together with a getter for oxygen containing a metal from group IVB or group VB of the periodic system. These numbers indicate the groups starting with atom number 22 and 23 respectively.

Lamps of the type described above are disclosed in British Patent Specification No. 1,409,957.

The above-mentioned metals are effective getters for oxygen which may be present in the lamp as such, combined in a metal oxide or combined in water. Oxygen gives rise to undesired reactions in the lamp which may cause a premature end of the life of the lamp. It is therefore important to make oxygen harmless by gettering it.

Although the affinity of the above-mentioned metals for hydrogen bromide is smaller than for oxygen, they also react with the hydrogen bromide in the lamp which is present in a much larger quantity than the quantity of free oxygen, but the quantity of hydrogen bromide is essential for the regenerative cycle to function in the correct manner.

In order to achieve the desired effect with the getter, the quantity thereof should therefore be matched to the quantity of oxygen which is to be expected to be present in the lamp.

The quantity of oxygen in the lamp is not present entirely in the gas mixture of the lamp from the first instant at which the lamp is in operation. A considerable part is released only during the initial period of operation of the lamp by desorption. This is the case notably when the lamp envelope does not consist of quartz glass but of a hard glass which in general contains more water than quartz glass.

In order to be able to getter all the oxygen in the lamp, the getter must be present in a larger quantity than is necessary to getter the quantity initially present in the gas mixture. Therefore, at the beginning of the life of the lamp the getter has an overcapacity as a result of which in the known lamp hydrogen bromide is also gettered.

It is the object of the invention to provide a lamp having an oxygen getter which does not affect hydrogen bromide so that the maximum quantity of gettering material in the lamp is not critical.

This object is achieved in lamps of the kind mentioned in the opening paragraph in that the getter for oxygen consists of an intermetallic compound of at least one first metal from the group consisting of tantalum, titanium, zirconium, hafnium and niobium and at least one second metal from the group consisting of palladium, platinum and gold, with the exception of tantalum/gold and niobium/gold compounds.

The said intermetallic compounds are formed from their components in strongly exothermic reactions and these intermetallic compounds are therefore very stable. The difference between the affinities of the said first metal of an intermetallic compound used in a lamp according to the invention for oxygen and for hydrogen bromide has the consequence that the intermetallic compound reacts with oxygen but does not react with hydrogen bromide. Consequently, these intermetallic compounds can be used in a halogen incandescent lamp in such a quantity that they are capable of gettering oxygen which is released in the course of the life of the lamp without exerting any detrimental influence on the quantity of hydrogen bromide present.

It is to be noted that a halogen incandescent lamp is known from German Auslegeschrift No. 2,020,921 having a getter which consists of titanium, tantalum, zirconium or aluminium and is enveloped with palladium or a palladium-nickel alloy. However, this known lamp differs essentially from a halogen incandescent according to the invention:

the getter is not an intermetallic compound but is a metal in elementary form which is surrounded by a second metal which is permeable to hydrogen but is impermeable to oxygen and halogen. The getter getters hydrogen but does not affect halogen and oxygen;

the lamp comprises iodine as a regenerative element and also contains hydrogen. For the functioning of a tungsten/iodine cycle, the presence of oxygen is essential the tungsten/iodine cycle only occurs via tungsten oxyiodides—the presence of hydrogen is detrimental. In fact, hydrogen considerably reduces the partial iodine pressure by the formation of hydrogen iodide.

In a tungsten/bromine cycle lamp the presence of hydrogen is essential to keep most of the bromine in the form of hydrogen bromide and thus to protect colder tungsten parts of the lamp from attack by free bromine. Oxygen is not necessary for the regenerative cycle with bromine and is detrimental because it gives undesired tungsten transport.

The said first metals can each form several intermetallic compounds with the second metals. Dependent on the ratio in which the metals are reacted, the getter comprises one or two intermetallic compounds. It is also possible that the getter consists of a mixture of several intermetallic compounds.

The intermetallic compounds of platinum and palladium are distinguished from those of gold in that their heats of formation and hence their stabilities are larger. The platinum compounds are distinguished in the same respect from the palladium compounds.

The getter may be present in the lamp in the form of a foil, a powder or a pill, generally in a location where the temperature is between 500° and 1500° C. during operation.

The minimum required quantity of getter depends on the impurities of the materials used in the lamp and on the efficiency of the cleaning procedure used in manufacturing a lamp. This quantity can be determined simply in a small series of tests for each type of lamp. As a result of the selectivity of the getter, however, it may be dosed in excess without any objections, which has for its advantage that fluctuations in the quality of produced lamps can be compensated for.

Figure 2:
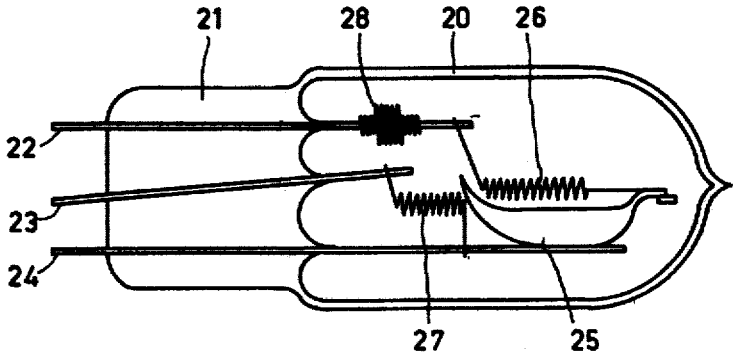

Two embodiments of lamps according to the invention are shown in the drawing, in which FIG. 1 is a schematic longitudinal section of a halogen incandescent lamp according to the invention, and FIG. 2 is a schematic longitudinal section of another lamp according to the invention.

In FIG. 1, a quartz glass lamp envelope 1 has two pinch seals 2 and 3 in each of which molybdenum foils 4 and 5, respectively, are incorporated. Limbs 8 and 9, respectively, of filament 10 are welded to the foils 4 and 5 at one end and external current conductors 6 and 7, respectively, are welded to the other end of the foils 4 and 5. The lamp envelope 1 contains a mixture of a rare gas and hydrogen bromide, and a hydrogen bromideresistant oxygen getter 11. The lamp may be used, for example, as a motor car-lamp.

FIG. 2 shows a lamp having a hard glass envelope 20 with a pinch seal 21. The envelope 20 consists of alkali metal aluminoborosilicate glass. Current supply conductors 22, 23 and 24 extend in a vacuum-tight manner through the pinch seal 21 into the envelope 20. A molybdenum cap 25 is connected to the current supply conductor 24 and partly surrounds a filament 26. A second filament 27 is accommodated between the current supply conductors 23 and 24. A wire 28 is wound around the current supply conductor 22. An oxygen getter in powder form is present between the current supply conductor 22 and the wire 28. The lamp may be used as a main beam and dipped beam automobile lamp.

Upon effecting the invention, experiments were carried out with lamps of a kind as shown in FIG. 1. The lamps had an internal volume of 0.27 $cm^3$ and were filled with a mixture of krypton and methylene bromide (100:0.35 vol/vol) to a pressure of 3.5 bar. The lamps consumed a power of approximately 60 W at 13.2 V.

A first series of lamps were tested without using a getter. The quality of a second series of lamps was impaired by adding 133.3 Pa oxygen to the gas mixture. No getter was used in these lamps.

In a third series of lamps, the same quantity of oxygen was used but 1 mg $TaPt_3$ was placed in the envelope as an oxygen getter. In a fourth series of lamps, 133.3 Pa oxygen and 3 mg $TaPt_3$ were used. The results of life tests are recorded in the following Table.

TABLE

| Example | $O_2$ (Pa) | $TaPt_3$ (mg) | life (hr) |
|---|---|---|---|
| 1 | 0 | — | 420 |
| 2 | 133.3 | — | 300 |
| 3 | 133.3 | 1 | 420 |
| 4 | 133.3 | 3 | 420 |

From these data it appears that the reduction of the life as a result of the presence of oxygen is cancelled by the use of 1 mg $TaPt_3$. A threefold quantity of getter has no detrimental effect on the life of the lamps.

What is claimed is:

1. A halogen incandescent lamp having a light-pervious envelope containing a gas filling comprising hydrogen bromide and a rare gas, in which envelope a tungsten filament is accommodated together with a getter for oxygen which contains a metal from the group IVB or VB of the periodic system, characterized in that the getter consists of an intermetallic compound of at least one first metal from the group consisting of tantalum, titanium, zirconium, hafnium and niobium and at least one second metal from the group consisting of palladium, platinum and gold, but excluding tantalum/gold and niobium/gold intermetallic compounds.

2. A halogen incandescent lamp as claimed in claim 1, characterized in that the second metal in the intermetallic compound is palladium or platinum.

3. A halogen incandescent lamp as claimed in claim 2, characterized in that the second metal in the intermetallic compound is platinum.

* * * * *